United States Patent [19]

Audeh et al.

[11] Patent Number: 4,981,577

[45] **Date of Patent: * Jan. 1, 1991**

[54] PROCESS FOR THE PRODUCTION OF NATURAL GAS CONDENSATE HAVING A REDUCED AMOUNT OF MERCURY FROM A MERCURY-CONTAINING NATURAL GAS WELLSTREAM

[75] Inventors: Costandi A. Audeh, Princeton, N.J.; Barry E. Hoffman, Duncanville, Tex.

[73] Assignee: Mobil Oil Corporation, Fairfax, Va.

[ * ] Notice: The portion of the term of this patent subsequent to Jan. 8, 2008 has been disclaimed.

[21] Appl. No.: 343,706

[22] Filed: Apr. 27, 1989

[51] Int. Cl.[5] ..... C01G 13/00; C01G 17/00; C01G 45/00; C07C 7/12

[52] U.S. Cl. ..... 208/251 R; 208/252; 210/914; 423/566.1; 423/210; 585/820; 585/856

[58] Field of Search ..... 423/210, 220, 232, 233, 423/566.1; 210/702, 716, 914; 208/251 R, 252, 246; 585/856, 820

[56] References Cited

U.S. PATENT DOCUMENTS

| | | | |
|---|---|---|---|
| 3,194,629 | 7/1965 | Dreibelbis | 423/210 |
| 3,286,992 | 11/1966 | Armeniades et al. | 423/DIG. 9 |
| 3,814,799 | 6/1974 | Wygash | 423/210 |
| 4,044,098 | 8/1977 | Miller et al. | 423/210 |
| 4,297,330 | 10/1981 | Schlauer et al. | 423/233 |
| 4,430,206 | 2/1984 | Rankel | 208/252 |
| 4,693,731 | 9/1987 | Tarakad et al. | 55/72 |

*Primary Examiner*—Jeffrey E. Russel
*Assistant Examiner*—Brian M. Bolam
*Attorney, Agent, or Firm*—Alexander J. McKillop; Charles J. Speciale

[57] ABSTRACT

A process for producing a natural gas condensate having a reduced amount of mercury from a mercury-containing natural gas wellstream, wherein the wellstream is separated into gaseous and liquid fractions. A portion of the gaseous fraction is mixed with the liquid fraction, the mixture is then separated into a stream comprising a natural gas condensate and at least one other stream comprising lower hydrocarbons and/or other gases. The natural gas condensate stream is then filtered.

24 Claims, 4 Drawing Sheets

PROCESS FOR THE PRODUCTION OF NATURAL GAS CONDENSATE HAVING A REDUCED AMOUNT OF MERCURY FROM A MERCURY-CONTAINING NATURAL GAS WELLSTREAM

BACKGROUND OF THE INVENTION

The present invention is directed to a process for the production of natural gas condensate, and specifically to a process for the production of natural gas condensate having a reduced amount of mercury from a mercury-containing natural gas wellstream.

Natural gas which is produced from a natural gas well is typically separated and purified to provide products for a variety of end uses. The high-pressure mixture produced from the well, i.e. the wellstream, is typically sent to a separator vessel or a series of separator vessels maintained at progressively lower pressures where the wellstream is separated into a gaseous fraction and a liquid fraction.

The gaseous fraction leaving the separator, which may contain the impurities mercury, carbon dioxide and hydrogen sulfide, is sent to a gas treatment and purification plant where, typically, the mercury concentration is reduced to $<0.1$ micrograms/$m^3$, the $CO_2$ concentration is reduced to the parts per million (ppm) level, and the $H_2S$ to about one (1) ppm.

The liquid fraction is typically preheated, e.g. to about 150° C., and is then sent to a stabilizer column. In the upper section of the stabilizer column, the stream is rectified, i.e., the heavy hydrocarbons are removed from the vapor phase, and in the lower section of the stabilizer column, the liquid stream is stripped of light hydrocarbon components. Complete stabilization can be further enhanced by heating the bottom liquid stream of the stabilizer column in a reboiler. The reboiler supplies additional heat in order to reduce the light hydrocarbon content of the liquid. The stabilizer column produces two streams: a stream which leaves the top of the stabilizer column containing gaseous components, e.g. $CO_2$, $H_2S$, etc., and low molecular weight hydrocarbons, e.g. $C_1$–$C_4$ and a stabilized condensate stream which leaves the bottom of the stabilizer column.

The purification of the gaseous fraction which may contain about 250 $\mu g/m^3$ mercury, about 15% by volume $CO_2$ and 80 ppm $H_2S$, is commonly achieved by passing the gaseous fraction over a bed of activated carbon which has been impregnated with sulfur. In this step, only the mercury in the gas reacts with the sulfur and is essentially removed from the gaseous fraction. Typically, the mercury content of the gas can be reduced to less than about 0.1 micrograms/$m^3$, however, the $H_2S$ and $CO_2$ content remain essentially unchanged. The gas leaving the sulfur/carbon bed is further treated for $CO_2$ and $H_2S$ removal in downstream processing.

It has been found that the mercury in wellstreams from gas producing wells which contain mercury is partitioned among the gaseous and liquid streams. This mercury is thought to originate from the geologic deposits in which the natural gas is entrapped. It will also be appreciated by those skilled in the art that trace amounts of nickel, vanadium, salt, moisture and sediment are typically present in the liquid fraction treated in accordance with the present invention.

Typical steps for the processing of the liquid fraction of the wellstream do not reduce the amount of mercury in the liquid fraction leaving the separator. For example, a liquid fraction leaving the separator having a mercury content of about 220 $\mu g/kg$ (ppb) will yield a stabilized condensate containing about 220 $\mu g/kg$ (ppb). The presence of mercury in a natural gas condensate is undesirable and can cause damage to downstream processing equipment.

Equipment damage may result when mercury accumulates in equipment constructed of various metals, especially aluminum, by forming an amalgam with the metal. For example, in the production of ethylene, cracked natural gas condensate is commonly passed through a heat exchanger constructed of aluminum. Such equipment exists in the section of the ethylene manufacturing facility where ethylene is separated from hydrogen, ethane and other hydrocarbons by chilling. It has been found that mercury tends to amalgamate with the aluminum of which the heat exchanger is constructed, thereby creating the risk of corrosion cracking with potentially catastrophic results.

SUMMARY OF THE INVENTION

The present invention provides for the production of a natural gas condensate having a reduced amount of mercury by directing a portion of the gaseous fraction from the separator or one of the separators when more than one is used, which is normally sent for further purification and separation, into the liquid fraction which has left the separator vessel(s) and been preheated. Alternatively, a portion of the gaseous fraction leaving the carbon/sulfur bed with a reduced mercury content may be directed into the liquid fraction. The gaseous fraction and the liquid fraction are mixed, e.g. in an inline static mixer. The mixture is then separated to yield a natural gas condensate stream having a reduced amount of mercury and a stream of low molecular weight hydrocarbons and/or other gases. The natural gas condensate stream is filtered to remove mercuric sulfide. The present invention reduces the risk of damage to expensive processing equipment, by providing a process for the production of a natural gas condensate having a significantly reduced amount of mercury.

DETAILED DESCRIPTION

The present invention provides a process for the production of a natural gas condensate having a significantly reduced amount of mercury from a mercury-containing natural gas wellstream. The process of the present invention may be practiced by modifying an existing plant used for the separation and purification of a natural gas wellstream. The present invention utilizes a portion of the separated gaseous fraction, a mixer, and a filter in order to affect the removal of mercury from the liquid fraction leaving the separator vessel(s).

Figure 1:
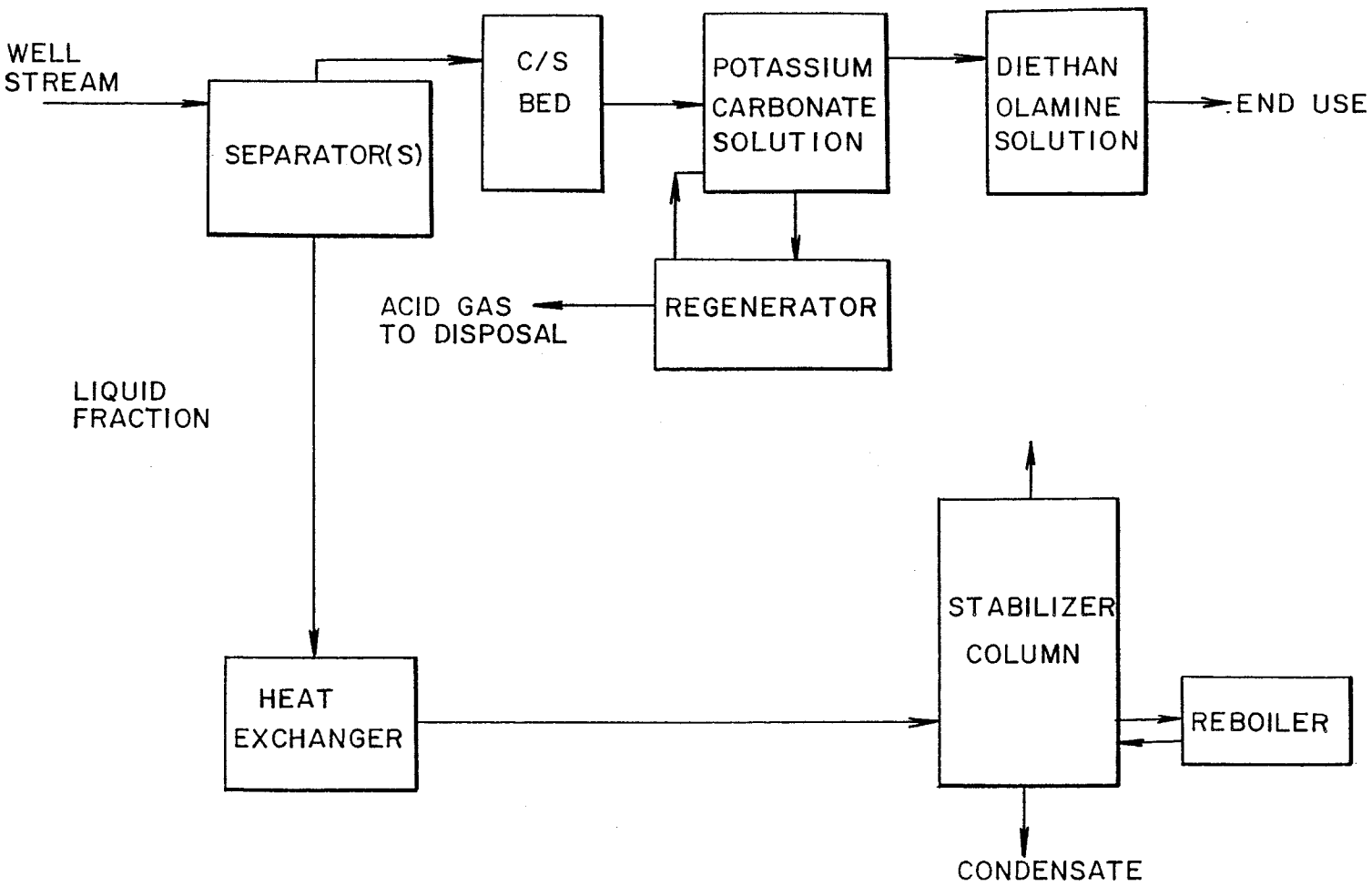
FIG. 1 (PRIOR ART)
FIG. 1 illustrates a conventional process for the separation and treatment of a wellstream of natural gas into its component parts.
Figure 2:
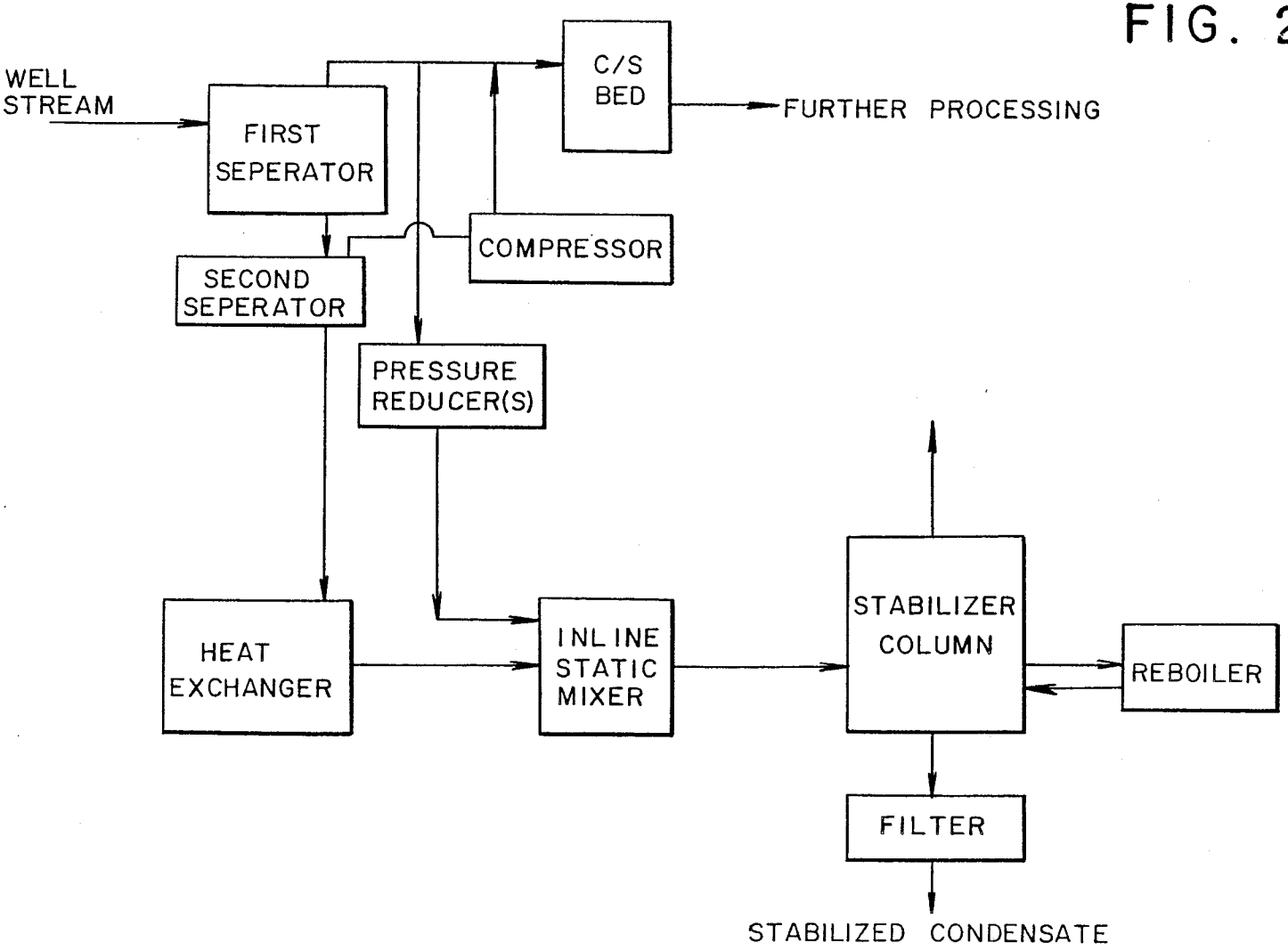
FIG. 2 generally illustrates the improved process of the present invention.

With reference to FIG. 2, in accordance with the present invention, a portion of the gaseous fraction, which, as stated above, contains $H_2S$, is mixed into the liquid fraction leaving the separator vessel(s). The liquid stream may be preheated in a heat exchanger, for example, to about 150° C. prior to mixing. Since the preheated liquid is typically at a lower pressure than the gaseous fraction, the gaseous fraction may be first sent through one or more pressure reducers in order to bring the pressure of that gaseous fraction to the pressure level of the preheated liquid fraction. Additionally, in order to ensure adequate contact between the preheated liquid and the gas, these two streams are mixed, for example, in an inline static mixer.

It is well known that mercury (Hg) will react with $H_2S$ according to the formula:

$$Hg+H_2S \rightarrow HgS+H_2$$

Since the amount of mercury in the liquid fraction, leaving the separator vessels, is much less than the amount of hydrogen sulfide in the gaseous fraction available for the above noted reaction, some hydrogen sulfide gas will remain in the mixture.

After this step, the mixture is separated into at least two streams, e.g., in a stabilizer column. One stream comprises a natural gas condensate having a reduced amount of mercury and another stream comprises lower molecular weight hydrocarbons, e.g. $C_1$–$C_4$, and/or other gases. If a stabilizer column is utilized, in the upper section of a stabilizer column the vapor phase of the mixture is rectified, i.e. the heavy hydrocarbons are removed from the vapor phase and, in the lower section of the stabilizer column, the liquid phase is stripped of light hydrocarbon components.

Since, the mercuric sulfide forms fine particles, the liquid phase leaving the stabilizer is then advantageously filtered, for example, with a filter having holes of about ½ micron to remove the product of the mercury and $H_2S$ reaction. It will be appreciated by those skilled in the art that any filtering technique capable of filtering out the mercuric sulfide will be suitable.

The amount of the gaseous fraction which should be mixed with the liquid fraction leaving the separator vessels will depend upon the hydrogen sulfide content of the gaseous fraction. For a gaseous fraction containing about 80 ppm $H_2S$, the volume of reduced pressure gaseous fraction should be at least about equal to the volume of the liquid fraction and is preferably in the range of from about half to 2½ times the volume of the liquid fraction. It will be appreciated by those skilled in the art that the process of the present invention can be carried out successfully using greater volumes of the gaseous fraction relative to liquid fraction.

Figure 3:
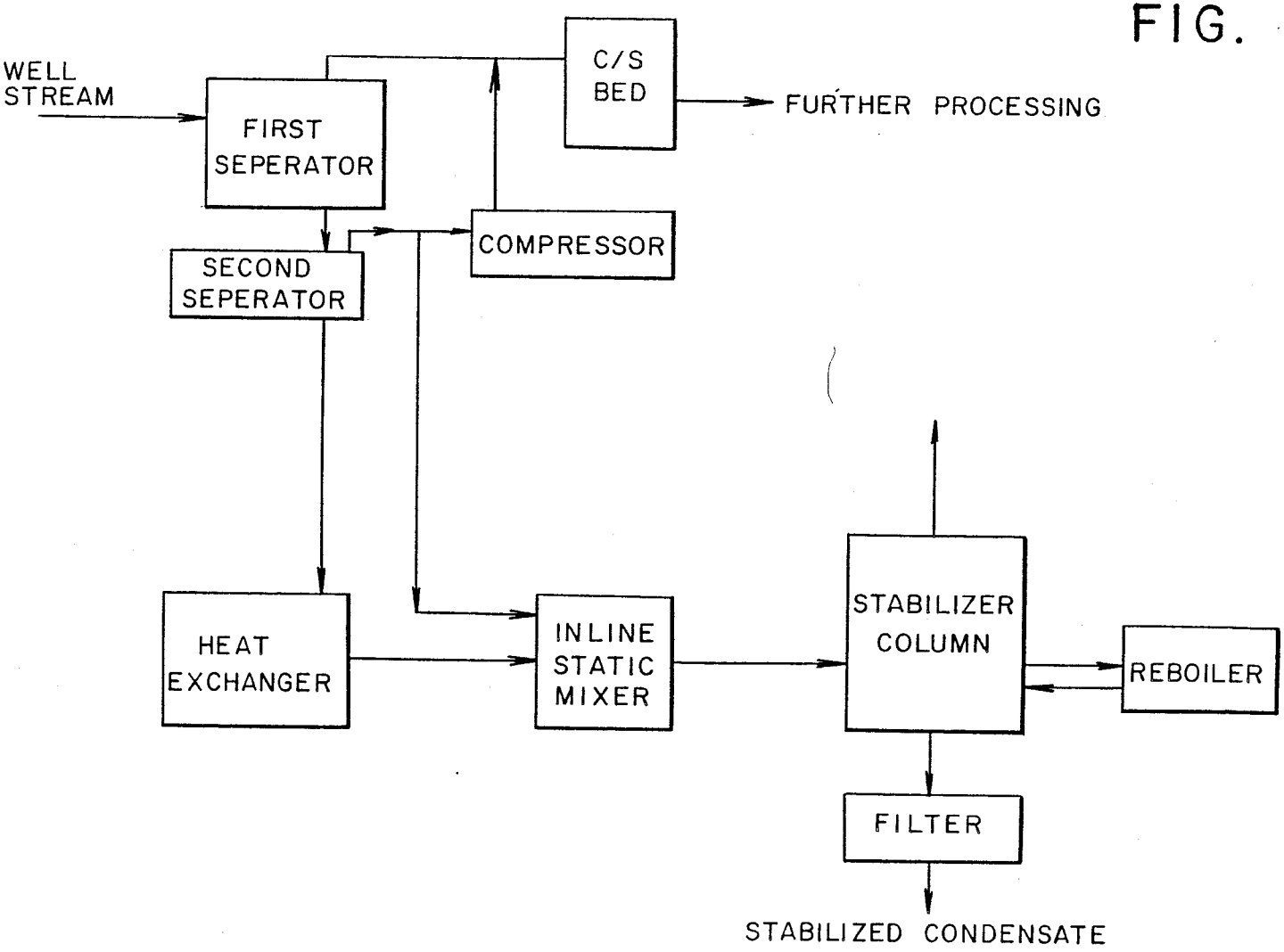
FIG. 3 generally illustrates a second embodiment of the improved process of the present invention.

With reference to FIG. 3, which illustrates a second embodiment of the present invention, a portion of the gas fraction leaving a second separator which contains $H_2S$, is mixed into the liquid fraction in the same manner as described above in reference to the gas fraction leaving the first separator. However, since the gas fraction leaving the second separator is at a lower pressure than the gas fraction leaving the first separator, the use of a pressure reducer may be unnecessary. With further reference to FIG. 3, it will be appreciated by those skilled in the art that the remainder of the gas fraction leaving the second separator, i.e., the portion which is not mixed with the liquid fraction, is sent to a compressor and then into the carbon/sulphur bed for removal of mercury and further processing.

Figure 4:
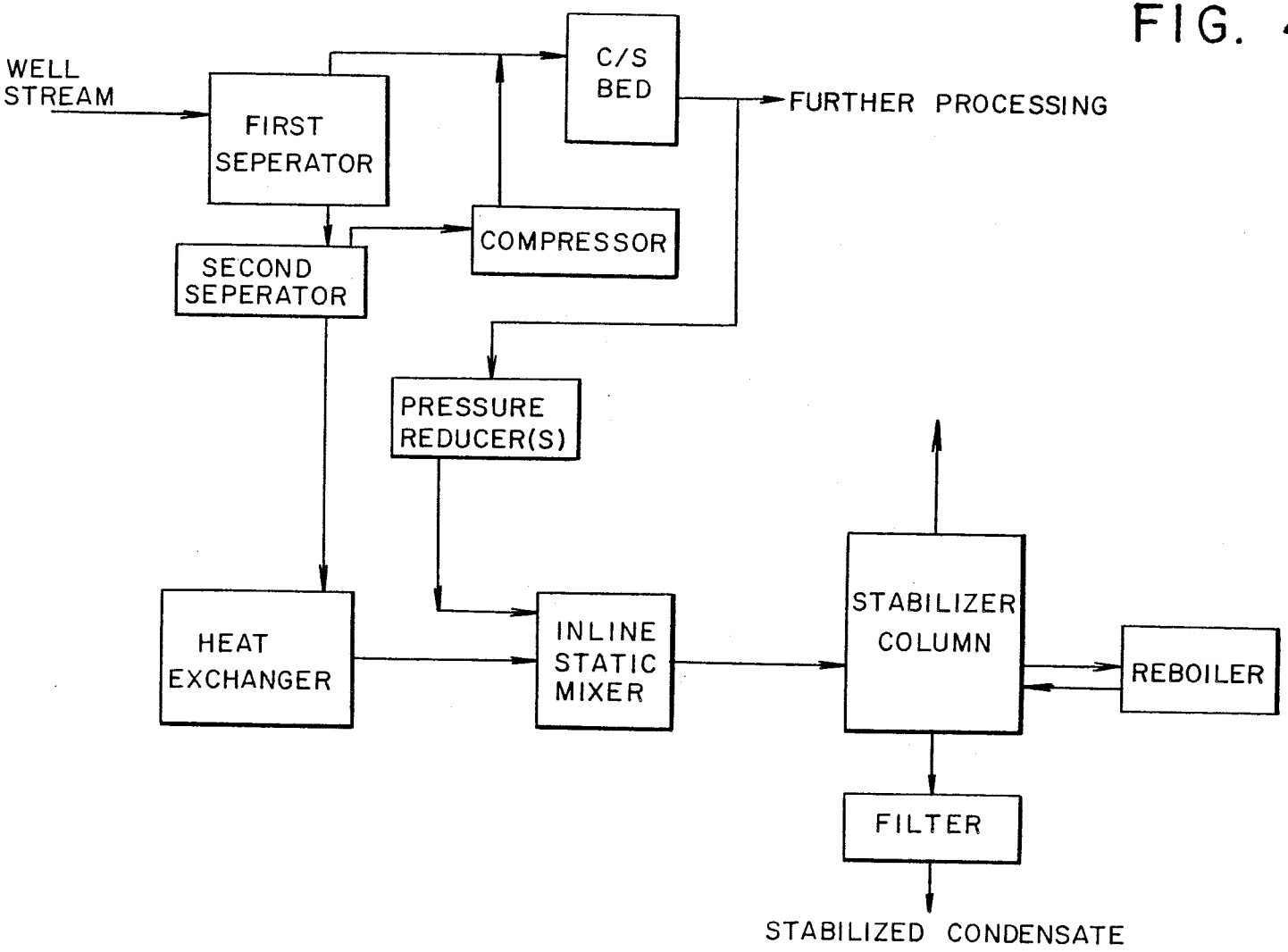
FIG. 4 generally illustrates a third embodiment of the improved process of the present invention.

With reference to FIG. 4, which illustrates a third embodiment of the present invention, a portion of the gas fraction leaving the C/S bed (having a reduced mercury content) is first sent to one or more pressure reducers and is then mixed with the liquid fraction in the same manner as described above.

The process of the present invention has been successful in reducing the amount of mercury in natural gas condensate from above about 200 ppb to below about 20 ppb. It will be appreciated by those skilled in the art that the mercury content of the natural gas condensate can be determined by conventional methods, such as ASTM method D-3223.

The present invention is further illustrated by the following examples:

EXAMPLE 1

As a control, 1 ml (about 1.2 g) of quartz chips held on a 16 mesh sieve was placed in a steel reactor equipped with a means for temperature control, pressure control, a means for heating, a feed pump, a 0.7 micron stainless steel filter, and a recovery system. A natural gas condensate which contained about 220 μg/kg (ppb) of Hg was introduced into the reactor at 260 psia and at a temperature of 150° C. The flow rate was 20 ml/hour. The product leaving the recovery system was cooled to room temperature and its Hg content was determined at hourly intervals.

Each sample taken over a period of 4 hours, had a Hg content of about 220 μg/kg, therefore, heating the condensate to 150° C. and passing it over quartz chips in a stainless steel reactor did not reduce the Hg content of the condensate.

EXAMPLE 2

A repeat of Example 1, however, in this case, $CH_4$ without $H_2S$, was co-fed with the condensate. After this treatment, the condensate had a Hg content of 220 μg/kg, i.e., heating the condensate co-fed with $CH_4$ to 150° C. and passing it over quartz chips in a stainless steel reactor did not reduce the Hg content of the condensate.

EXAMPLE 3

A repeat of Example 2, however, in this case, $CH_4$ containing about 200 ppm $H_2S$ was co-fed with the condensate over the same quartz chips and in the same system used in Example 1 and under the same process conditions. The gas/condensate mixture was allowed to flow for 24 hours. Samples of the condensate, after separation from the $CH_4$ which contained $H_2S$, taken at regular intervals, had a Hg content of less than about 20 ppb.

Examples 1 and 2 show that heating the condensate to 150° C. in the presence or absence of $CH_4$ does not reduce its Hg content. However, Example 3 shows that in the presence of $CH_4$ containing $H_2S$, the Hg content of the condensate is reduced.

The present invention provides a process for producing a natural gas condensate having a significantly reduced content of mercury. The process may be carried out with relatively minor modifications to an existing plant used for the separation and purification of a natural gas wellstream.

We claim:

1. A process for the production of a natural gas condensate having a reduced amount of mercury from a mercury-containing natural gas wellstream comprising the steps of:

separating said wellstream into a gaseous fraction and a liquid fraction, preheating said liquid fraction, mixing a portion of said gaseous fraction with said preheated liquid fraction, separating said mixture into a first stream comprising light hydrocarbon components and a second stream comprising a natural gas condensate, and filtering said second stream to remove mercuric sulfide.

2. A process according to claim 1 wherein said mixture is separated in a stabilizer column.

3. A process according to claim 1 wherein said mixing is performed in an inline static mixer.

4. A process according to claim 1 wherein the pressure of said portion of said gaseous fraction is reduced prior to mixing said gaseous fraction with said liquid fraction.

5. A process according to claim 1 wherein said filtering comprises passing said second stream through a filter having holes of about ½ micron.

6. A process according to claim 1 wherein said wellstream is separated in more than one separator vessel and wherein said portion of said gaseous fraction originates from a first separator.

7. A process according to claim 1 wherein said wellstream is separated in more than one separator vessel and wherein said portion of said gaseous fraction originates from a second separator.

8. A process according to claim 1 wherein said portion of said gaseous fraction is passed over a bed comprising activated carbon prior to mixing.

9. A process according to claim 8 wherein said activated carbon bed comprises sulphur.

10. A process for the production of a natural gas condensate having a reduced amount of mercury from a mercury-containing natural gas wellstream comprising the steps of:

separating said wellstream into a gaseous fraction and a liquid fraction, preheating said liquid fraction, reducing the pressure of a portion of said gaseous fraction, mixing said reduced pressure portion of said gaseous fraction with said preheated liquid fraction, separating said mixture into a first stream comprising light hydrocarbon components and a second stream comprising a natural gas condensate, and passing said mixture through a filter to remove mercuric sulfide.

11. A process according to claim 10 wherein said mixture is separated in a stabilizer column.

12. A process according to claim 10 wherein said mixing is performed in an inline static mixer.

13. A process according to claim 10 wherein said filter has holes of about ½ micron.

14. A process according to claim 10 wherein said wellstream is separated in more than one separator vessel and wherein said portion of said gaseous fraction originates from a first separator.

15. A process according to claim 10 wherein said wellstream is separated in more than one separator vessel and wherein said portion of said gaseous fraction originates from a second separator.

16. A process according to claim 10 wherein said portion of said gaseous fraction is passed over a bed comprising activated carbon prior to mixing.

17. A process according to claim 16 wherein said activated carbon bed comprises sulphur.

18. A process for the production of a natural gas condensate having a reduced amount of mercury from a mercury-containing natural gas wellstream comprising the steps of:

separating said wellstream into a gaseous fraction and a liquid fraction, preheating said liquid fraction, reducing the pressure of a portion of said gaseous fraction, mixing said reduced pressure portion of said gaseous fraction with said preheated liquid fraction, separating said mixture in a stabilizer column into a first stream comprising light hydrocarbon components and a second stream comprising a natural gas condensate, and passing said mixture through a filter to remove mercuric sulfide.

19. A process according to claim 18 wherein said mixing is performed in an inline static mixer.

20. A process according to claim 18 wherein said filter has holes of about ½ micron.

21. A process according to claim 18 wherein said wellstream is separated in more than one separator vessel and wherein said portion of said gaseous fraction originates from a first separator.

22. A process according to claim 18 wherein said wellstream is separated in more than one separator vessel and wherein said portion of said gaseous fraction originates from a second separator.

23. A process according to claim 18 wherein said portion of said gaseous fraction is passed over a bed comprising activated carbon prior to mixing.

24. A process according to claim 23 wherein said activated carbon bed comprises sulphur.

* * * * *